US009192984B2

(12) United States Patent
Lesters

(10) Patent No.: US 9,192,984 B2
(45) Date of Patent: Nov. 24, 2015

(54) WASTE FOUNDRY SAND TO FRAC SAND PROCESS

(71) Applicant: Francis A. Lesters, Naperville, IL (US)

(72) Inventor: Francis A. Lesters, Naperville, IL (US)

( * ) Notice: Subject to any disclaimer, the term of this patent is extended or adjusted under 35 U.S.C. 154(b) by 70 days.

(21) Appl. No.: 14/065,651

(22) Filed: Oct. 29, 2013

(65) Prior Publication Data

US 2015/0114888 A1 Apr. 30, 2015

(51) Int. Cl.

| | |
|---|---|
| ***B03C 1/30*** | (2006.01) |
| ***B22C 5/06*** | (2006.01) |
| ***B22C 5/18*** | (2006.01) |
| ***B03C 1/20*** | (2006.01) |

(52) U.S. Cl.

CPC ... *B22C 5/06* (2013.01); *B03C 1/20* (2013.01); *B03C 1/30* (2013.01); *B22C 5/18* (2013.01); *B03C 2201/20* (2013.01)

(58) Field of Classification Search

USPC ..... 209/38

See application file for complete search history.

(56) References Cited

U.S. PATENT DOCUMENTS

| | | | | |
|---|---|---|---|---|
| 4,144,088 | A * | 3/1979 | Adams | 134/2 |
| 4,700,766 | A * | 10/1987 | Godderidge | 164/5 |
| 5,797,496 | A * | 8/1998 | Kirchen et al. | 209/2 |
| 2010/0270885 | A1 * | 10/2010 | Izquierdo | 310/152 |
| 2011/0031166 | A1 * | 2/2011 | Graham | 209/19 |
| 2011/0094941 | A1 * | 4/2011 | Guschall et al. | 209/7 |

FOREIGN PATENT DOCUMENTS

| | | | | |
|---|---|---|---|---|
| CN | 102886493 | A * | 10/2012 | 209/38 |
| JP | 58138539 | A * | 8/1983 | B22C 5/06 |

* cited by examiner

*Primary Examiner* — Terrell Matthews
(74) *Attorney, Agent, or Firm* — Vincent Re PLLC

(57) ABSTRACT

Foundries utilize quartz foundry sand and generate waste foundry sand as a by-product. Frac sand exists with other components within the waste foundry sand. A configuration of machinery processing a flow of quartz waste foundry sand into frac sand includes a screening device separating the flow and providing the frac sand.

3 Claims, 5 Drawing Sheets

WASTE FOUNDRY SAND TO FRAC SAND PROCESS

CROSS REFERENCE TO RELATED APPLICATIONS

This disclosure claims the benefit of U.S. Provisional Application No. 61/719,680 filed on Oct. 29, 2012 which is hereby incorporated by reference.

TECHNICAL FIELD

This disclosure is related to a process to convert normally wasted spent foundry sand into usable frac sand.

BACKGROUND

The statements in this section merely provide background information related to the present disclosure. Accordingly, such statements are not intended to constitute an admission of prior art.

Foundry sand is a quartz sand used in a process to refine and form molten metal into usage forms. The metal can be iron or other metals. Foundry sand can be combined with a bonding agent to aid the sand in retaining a shape, including clay or other chemical agents, and the sand can be formed into a mold to receive molten metal in a casting process. The foundry sand can include other additives to change properties of the sand. The molten metal is allowed to cool in the mold, and once the metal is cooled enough to retain its shape, the foundry sand can be separated from the metal. The foundry sand can be reused a number of times. However, the composition of the foundry sand mixture is changed through repeated casting cycles, and eventually the foundry sand must be removed from service and new foundry sand introduced. Foundry sand that can no longer be used is considered waste foundry sand. Waste foundry sand can be found to have other minerals included for the purpose of hardening. It can be recycled internally, but at some point the value is expended. The final waste foundry sand can also have metallic substances incorporated as a by-product of the metal casting process. One estimate includes 6 to 10 million tons of waste foundry sand being generated every year.

Frac sand is a particular grade of quartz sand, specified to a particular shape and size. Frac sand is useful in a number of applications, including in the petroleum industry wherein frac sand is injected into an oil well for the purpose of maximizing the total output of the well.

Foundry sand and frac sand can be produced at the same mines and may be produced from the same raw material. They are a silica/quartz mineral that is unique in shape, chemistry and physical properties. Frac sand has particular requirements that the sand particles must meet for sphericity, roundness, gradation and crush resistance. One primary difference between materials used for foundry sand and for frac sand is gradation requirements. The foundry sand has a wider acceptable gradation range.

Disposal of waste foundry sand is known to include uses wherein the waste foundry sand is used as filler. Civil engineering applications use waste foundry sand as landfill or material to build up a desired embankment. In this use, waste foundry sand is essentially treated as inert waste. The value of fresh foundry sand greatly exceeds the value of landfill for civil engineering uses. The value of frac sand greatly exceeds the value of landfill for civil engineering uses.

SUMMARY

Foundries generate waste foundry sand including a quartz based sand with contaminants from the foundry process. Frac sand exists with other components within the waste foundry sand. A configuration of machinery processing a flow of quartz waste foundry sand into frac sand includes a screening device separating the flow and providing the frac sand.

BRIEF DESCRIPTION OF THE DRAWINGS

One or more embodiments will now be described, by way of example, with reference to the accompanying drawings, in which.

DETAILED DESCRIPTION

Foundry sand utilized in an industrial foundry is exposed to high temperatures, contaminants such as ferrous material and binding chemicals, such that the foundry sand must eventually be disposed of as waste foundry sand. While some of the particles in the waste foundry sand are damaged, altered, or otherwise rendered unusable as frac sand, a fraction of the particles within the waste foundry sand conform to frac sand particles. A process is disclosed to separate conforming frac sand particles from a waste foundry sand flow including utilizing a magnetic device to remove ferrous material from the flow and a screening device to separate from the flow a flow of conforming frac sand.

Figure 1:
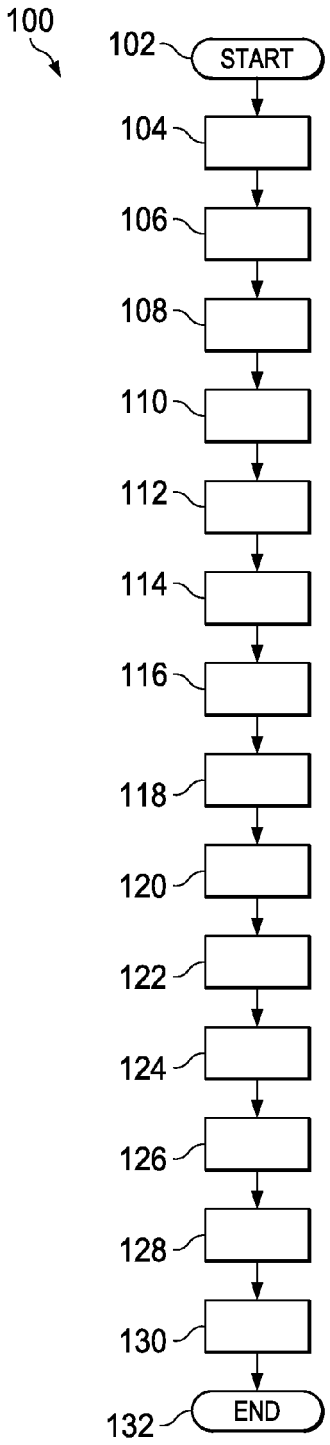
FIG. 1 illustrates an exemplary process for converting waste foundry sand to frac sand, in accordance with the present disclosure.

Referring now to the drawings, wherein the showings are for the purpose of illustrating certain exemplary embodiments only and not for the purpose of limiting the same, FIG. 1 illustrates an exemplary process for converting waste foundry sand to frac sand. Process 100 begins at step 102. At step 104, waste foundry sand is collected for refurbishing, for example on-site at a foundry or at a holding area serving a number of foundries, and the foundry sand is stored awaiting a sufficient quantity to make it worthwhile to process on site or can be collected and taken to a designated processing site. The feed being used in process 100 which becomes a waste foundry sand flow includes silica/quartz sand of the same type and source used to produce frac sand. The sand in the feed stream includes a wider range of size, shape, gradation, etc. than are permitted in frac sand. Storing the foundry sand and processing it in batches can be useful for creating economies of scale in processing the waste foundry sand, although it will be appreciated that the methods used herein can be scaled down or run intermittently to provide for smaller batches and less on-site storage of foundry sand. At step 106, the process for refurbishing waste foundry sand utilizes plant equipment to process and transport the waste foundry sand. According to one exemplary embodiment, an end loader with sufficient capacity to keep up with processing the waste foundry sand is utilized to move the sand. In another embodiment, hoppers and auger or conveyor systems can be utilized to transport waste foundry sand. In another embodiment, gravity fed chutes can be used to transfer waste foundry sand from one location to another. At step 108, the exemplary end loader transfers the waste foundry sand into an exemplary hopper with a two inch grizzly bars with sufficient capacity to keep up with processing the waste foundry sand. Unprocessed waste foundry sand can be compacted or treated with chemicals to retain a shape. Such unprocessed sand, in large chunks, would be unmanageable in many configurations or equipment. Grizzly bar screens are known in the art as devices used to process, break-down, and permit a processed material feed with particles or chunks below a particular size to exit the screen. At step 110, the hopper becomes a surge for the system holding several bucket loads of the waste foundry sand. At step 112, a device called a feeder proportions and provides to a conveyor a uniform or semi-uniform feed stream of the waste foundry sand or a waste foundry sand flow in a quantity sufficient capacity to keep up with processing. At step 114, a conveyor moves the waste foundry sand flow from the feeder to an overband magnet. At step 116, the overband magnet is applied to the waste foundry sand flow to separate metallic materials from the waste foundry sand flow. The overband magnet and supporting equipment are sized and selected including sufficient capacity to keep up with the processing. An alternate or supplemental step 118 can include utilizing a head pulley magnet device known in the art to remove ferrous material from the waste foundry sand flow. At step 120, a screening device or devices embodied as a screen and screen cloth device or devices can be used to separate the sand in the feed stream into various sorted feed streams. As a result of the separation into a specification finished product gradation of 40 Mesh×70 Mesh Frac Sand. At step 122, a hopper and conveyor capable of handling sufficient material capable of sufficient capacity to process the sorted frac sand moves or channels the finished frac sand. Steps 124 and 126 can deposit frac sand into exemplary stockpile-A and stockpile-B, either simultaneously or sequentially, for testing and for future transport to customers. At step 128, oversized products are collected and removed. At step 130, undersized products are collected and removed. Other exemplary steps could collect ferrous materials or non-round particles separated from the waste foundry sand flow. Process 100 ends at step 132. One having skill in the art will appreciate that the portions of the feed stream not conforming to the desired frac sand specification can be sorted into other useful materials.

Sand used in the casting process is exposed to high temperatures, which can cause thermal changes in the sand. For example, sand particles can fracture into non-round particles. A number of screen configurations or combinations of screens can be utilized to separate sand materials. No particular screen is necessary just the indication that anything over frac sand specification size and under the frac sand specification size will have to be removed. This gradation adjustment is implemented to eliminate the sphericity and roundness violations that occurred from the thermal change during the casting process. The screening of the waste sand provided a sand envelope of spherical and roundness that met the frac sand requirements.

Use of the above measures to ensure gradation based upon frac sand specification have shown in testing to produce sand conforming to Frac Sand specification ISO 13503-2/API RP19C. A screening device can be equipped with meshes to separate out such a specific range of sand particles from the non-conforming sand particles.

Figure 2:
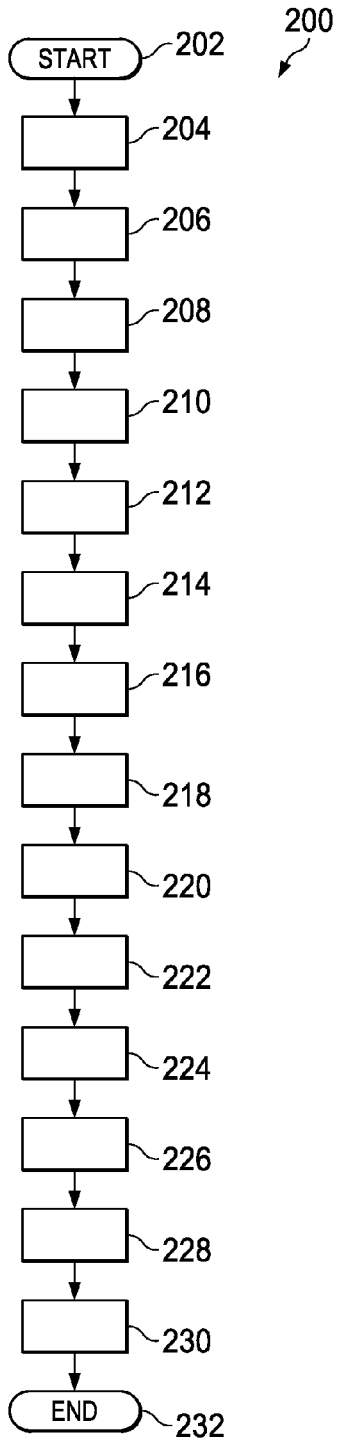
FIG. 2 illustrates another embodiment of an exemplary process for converting waste foundry sand to frac sand, in accordance with the present disclosure.

FIG. 2 illustrates another embodiment of an exemplary process for converting waste foundry sand to frac sand. Process 200 begins at step 202. At step 204, a delivery truck 200 provides transportation of waste foundry sand from one or more foundries to a processing facility. At step 206, the truck delivers the foundry sand to the processing facility as a waste foundry sand stockpile. At step 208, an endloader or excavator acquires raw material from the stockpile and delivers the material to a grizzly bar screen device. Any method to move sand from the stockpile to the grizzly device can be utilized, and the disclosure is not intended to be limited to the use of the machinery provided as an example. According to one embodiment, the raw materials in stockpile can be mixed or blended to prevent processes disclosed herein from producing varying cycles of conforming frac sand particles with heterogeneous properties. For example, sand from a particular foundry can include particularly small particles as compared to other foundries, such that a frac sand flow generated from that particular sand would tend toward particles on the small side of the frac sand standard. By blending the raw materials prior to processing the materials, a more uniform or homogenous output can be generated. According to one exemplary process, trucks can dump materials in first vertical configuration, with multiple parallel rows of raw materials, and the excavator can pick up the raw materials in a second horizontal configuration, thereby taking material simultaneously from the multiple rows. At step 210, the raw materials delivered by the excavator is processed by the grizzly device. At step 212, a feed from the grizzly device is fed into a hopper. At step 214, materials are measured out of the hopper by a feeder as a waste foundry sand flow. At step 216, a conveyor transports the waste foundry sand flow to an overband magnet station. At optional step 218, augmenting or replacing step 216, the conveyor transports the waste foundry sand flow to a head pulley magnet. At step 218, the conveyor transports the waste foundry sand flow to a screen station or a series of screen stations, whereat processes disclosed herein are used to separate different sizes and shapes of sand. At step 220, a rotary conveyor deposits sand to a holding area or areas. According to one embodiment, a holding area can be pile on the ground. In another embodiment, the holding area can be a hopper or a bin. According to one exemplary process, a rotary material conveyor can be used to deliver the frac sand to a plurality of finished piles, permitting constant production of the material while producing at least one finished pile that can be tested or prepared for shipment. The rotary conveyor of step 220 according an exemplary configuration delivers frac sand in two piles. At step 222, sand in a first finished pile can be inspected. At step 224, sand can be delivered into a current receiving pile while the sand in the finished pile is being inspected. At step 226, sand from the finished pile, once inspected, can be transported to a frac sand collection point. At step 228, a shipment of finished frac sand is provided from the frac sand collection point. At step 230, non-conforming sand particles are collected and processed. Process 200 ends at step 232.

Figure 3A:
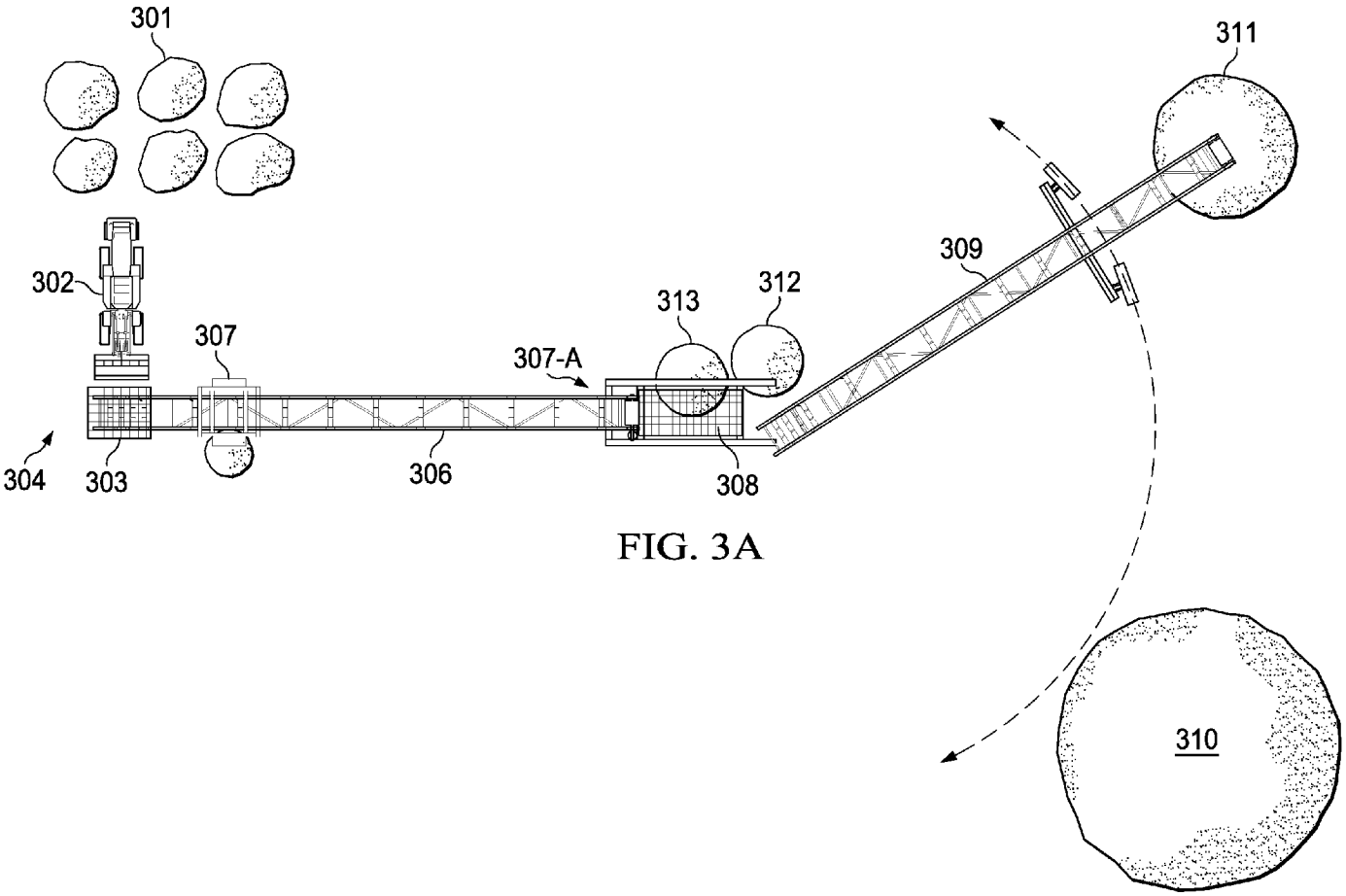
FIGS. 3A-3C illustrate an exemplary configuration of equipment to process waste foundry sand into frac sand according to the flow chart of FIG. 2, in accordance with the present disclosure.
Figure 3B:
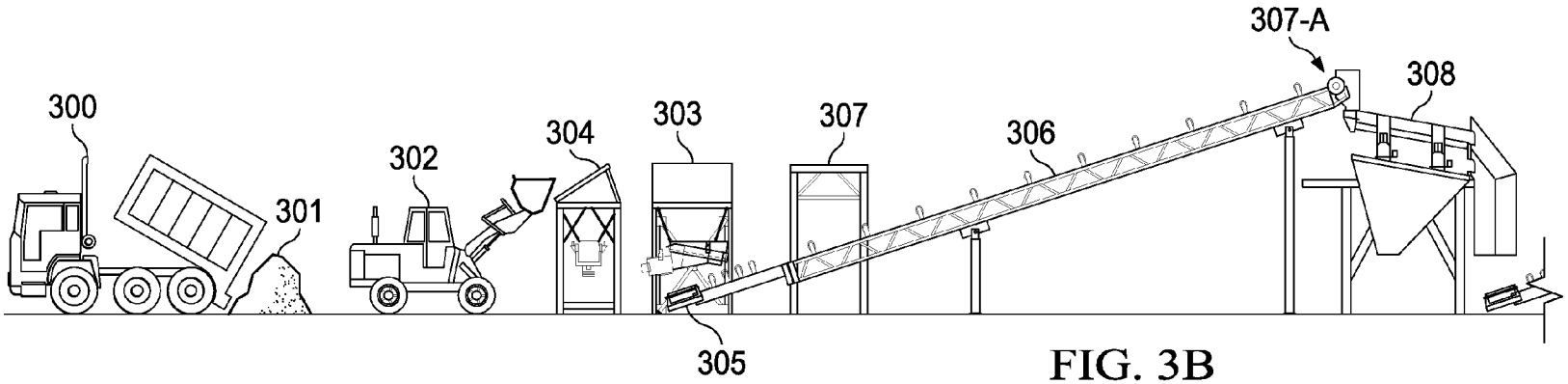
Figure 3C:
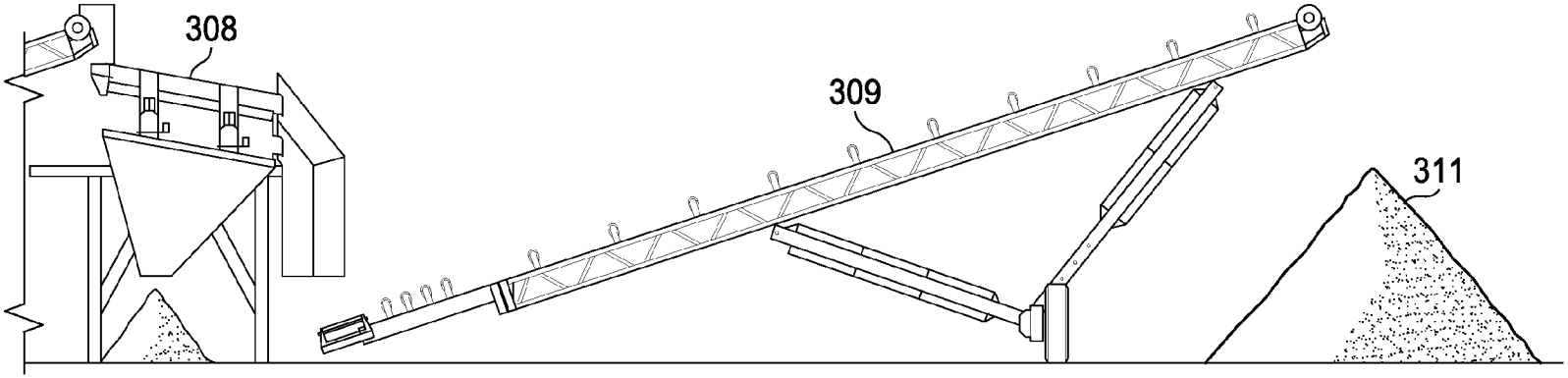

FIGS. 3A-3C illustrate an exemplary configuration of equipment to process waste foundry sand into frac sand according to the flow chart of FIG. 2. FIG. 3A is an overhead view, including excavator 302 processing material from waste foundry sand stockpiles 301. Grizzly bar screen device 303 is illustrated receiving a material feed from the excavator 302. Grizzly device 303 provides a waste foundry sand flow to conveyor 306. Conveyor 306 transports the flow first through an overband magnet device 307 and later through head pulley magnet device 307A. The waste foundry sand flow passes through screening device 308, which applies a mesh or a plurality of meshes to separate the sand as disclosed herein. Non-conforming sand piles 312 and 313 are illustrated. Conveyor 309 is illustrated capable of rotating between a plurality of locations to generate frac sand piles. A finished frac sand pile 310 is illustrated. An in-process frac sand pile 311 is additionally illustrated.

FIG. 3B is a side view of a first portion of the equipment of FIG. 3A. A truck 300 is illustrated dumping sand onto a stockpile 301. excavator 302 processing material from waste foundry sand stockpiles 301. Hopper device 304 is illustrated receiving material from excavator 302. Grizzly bar screen device 303 is illustrated receiving material from hopper 304. Grizzly device 303 provides a waste foundry sand flow to conveyor 306. Conveyor 306 transports the flow first through an overband magnet device 307 and later through head pulley magnet device 307A. The waste foundry sand flow passes through screening device 308, which applies a mesh or a plurality of meshes to separate the sand as disclosed herein.

FIG. 3C is a side view of a second portion of the equipment of FIG. 3A. The flow of waste foundry sand is separated by screening device 308, and a flow of conforming frac sand is provided to conveyor 309. conveyor 309 can rotate. In another embodiment, the conveyor can be fixed. In one embodiment, a series of movable hoppers or rail cars could be sequentially stationed under conveyor 309 to receive the flow of frac sand. As is illustrated in FIG. 3C, device 308 can include a tilted body, such that sand is force by gravity to flow over and through a series of meshes within device 308. Frac sand is transported by conveyor 309 to be deposited upon sand pile 311. The process and related machinery of FIGS. 3A to 3C are provided as an exemplary configuration to accomplish processes disclosed herein. However, different machinery arranged or the illustrated machinery arranged in a different shape or in a different order of operation could accomplish the processes disclosed herein. The disclosure is not intended to be limited to the particular examples provided herein.

Figure 4:
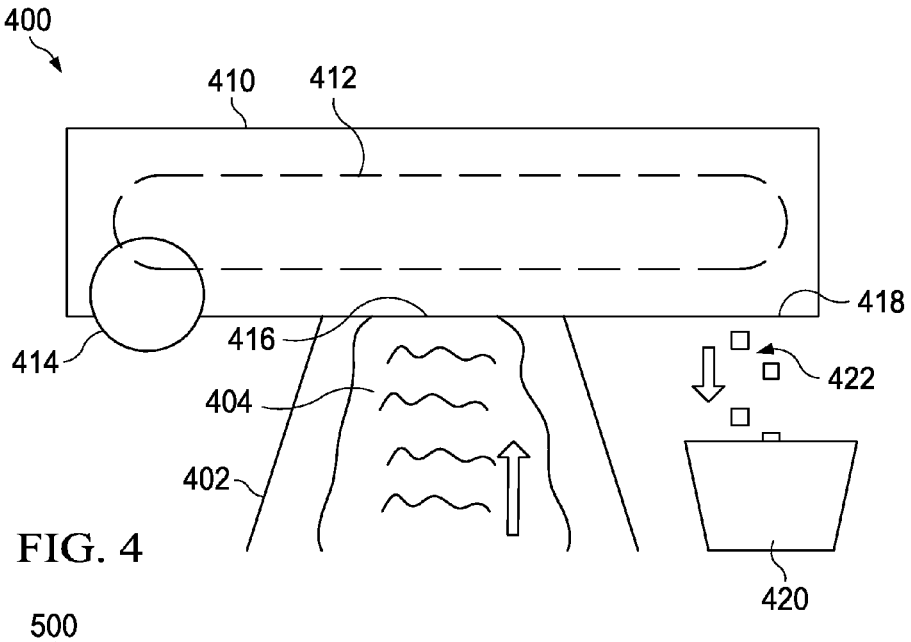
FIG. 4 illustrates an exemplary overband magnet separating ferrous material from a waste foundry sand flow, in accordance with the present disclosure.

FIG. 4 illustrates an exemplary overband magnet separating ferrous material from a waste foundry sand flow. Configuration 400 includes overband magnet device 410 removing ferrous material from a flow 404 of waste sand being conveyed under device 410. Conveyor device 402 is illustrated, for example, including a reinforced polymer belt propelled by an industrial motor to contain and convey a granular flow according to conveyor constructions known in the art. Overband magnet device 410 can include any of a number of known configurations wherein a magnet is used to remove ferrous material from a material flow. In the particular embodiment of FIG. 4, device 410 includes an internal magnetized conveyor apparatus 412 powered by an industrial electric drive motor 414. Device 410 includes a flow interface 416 whereat the conveyor apparatus 412 interacts with flow 404. Conveyor apparatus 412 includes magnetic fixtures that, when passed over flow 404, utilize magnetic attraction to affix ferrous particles to the magnetic fixtures. Conveyor apparatus 412 further includes outlet 418, whereat the ferrous particles are separated from conveyor apparatus 412 and are permitted to fall from outlet 418 as ferrous particle flow 422 into hopper 420. Configuration 400 is provided as an exemplary illustration of an overband magnet device removing ferrous particles from a waste foundry sand flow. Other embodiments are envisioned, and the disclosure is not intended to be limited to the particular examples provided herein.

Figure 5:
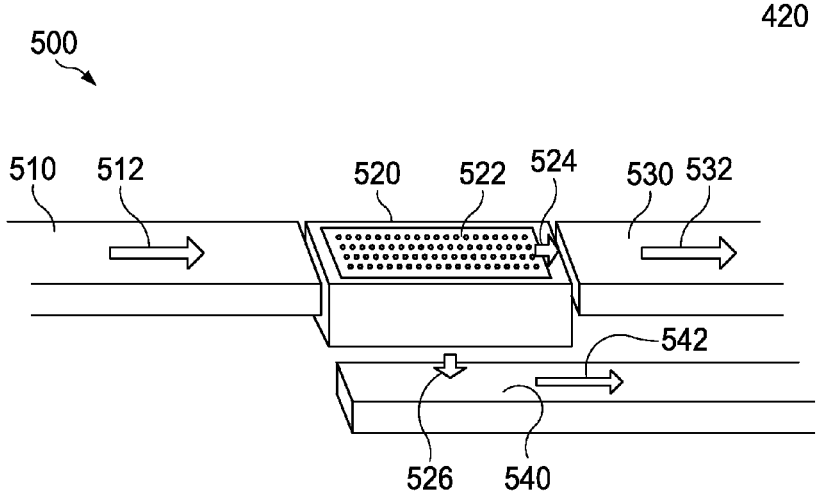
FIG. 5 illustrates an exemplary screening device separating a flow of waste foundry sand based upon geometry of the sand particles, in accordance with the present disclosure.

FIG. 5 illustrates an exemplary screening device separating a flow of waste foundry sand based upon geometry of the sand particles. Configuration 500 includes conveyors 510, 530, and 540 facilitating separation of a waste foundry sand flow 512 into a conforming frac sand flow 542 and a non frac sand flow 532 with screening device 520. Flow 512 includes a particle flow of sand particles of different shapes and sizes. As disclosed herein, sand particles used in a foundry process can be distorted from an original shape or size. Screening device 520 includes a screen mesh 522 including hole sizes configured to separate particles based upon a geometric criteria. For example, screening device with a mesh can be used with hole sizes permitting particles smaller than the size specified for frac sand to fall through the mesh. The flow that does not fall through the mesh can subsequently be passed over a second mesh of a second screening device, the mesh sized to only permit particles the size of frac sand or smaller to fall through the mesh. Use of these two screening devices such that particles too large and too small are separated from the flow can be used to separate conforming frac sand particles from non-conforming sand particles. Similarly, a mesh with oblong or oval holes can be used to separate non-round particles from round particles. In one embodiment, a single mesh can include small holes, permitting sand particles that are too small to pass through, and oblong holes permitting non-round particles to fall through the same mesh. In the exemplary embodiment of FIG. 5, the flow 512 is fed to screening device 520 including mesh 522. Device 520 vibrates or otherwise agitates the sand flow passing over mesh 522 according to methods known in the art, such that a flow 526 of particles falls from device 520 onto conveyor 540 and a second flow 524 of particles moves from device 520 onto conveyor 530. A number of alternative embodiments of screening devices are envisioned, and the disclosure is not intended to be limited to the particular examples provided herein.

Device 520 illustrates one example of a screening device providing a mesh for separating a flow of sand into different flows. Screening devices are known in the art and will not be disclosed in detail herein. In one embodiment, the screening device will be slanted from high side corresponding to a flow input and lower side corresponding to an output so material flows downward on the screen which is vibrating to force the material through the screen. Also the device could have several decks, in one embodiment, three, providing flexibility in the equipment in the event a grain size requirement were to change in the future.

Various alternative embodiments are anticipated by the disclosure. One conveyor line could remove ferrous material, and an excavator could deliver output from that line to a second line equipped with a screening device in accordance with the present disclosure. One facility could remove ferrous material, and the material could be shipped to an entirely different facility for a screening process to be performed. In an embodiment where a supply of waste foundry sand is available that is known to be free or nearly free of ferrous material, a process could be utilized omitting the magnetic device disclosed to remove the ferrous material.

A mechanized process for converting a flow of quartz waste foundry sand into frac sand can be described based upon the present disclosure. The process includes processing a particulate flow of waste foundry sand to remove metallic components of the particulate flow and screening the particulate flow to remove all non conforming sand particles and create a flow of conforming frac sand particles. It will be appreciated that such a mechanized process is controlled by a computer or electronically actuated devices known in the art.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A configuration of machinery processing a flow of quartz waste foundry sand into frac sand, the configuration comprising:

a hopper device receiving waste found sand material;

a grizzly bar screening device receiving the waste foundry sand material from the hopper device and providing a processed material feed;

a feeder receiving the processed material feed and providing the flow;

an overband magnetic device;

a head pulley magnet device; and a screening device separating the flow and providing the frac sand.

2. The configuration of claim 1, wherein the screening device comprises a mesh including holes configured to separate sand particles based upon size.

3. The configuration of claim 2, wherein the mesh is further configured to separate non-round particles from round particles.

* * * * *